United States Patent [19]

Seifert et al.

[11] Patent Number: 4,653,988

[45] Date of Patent: Mar. 31, 1987

[54] TEMPERATURE SWITCH MOUNTING MEANS FOR A FUNCTION-MONITORING FAN

[75] Inventors: Rolf Seifert; Volker Schlicker, both of Radevormwald, Fed. Rep. of Germany

[73] Assignee: Ing. Rolf Seifert Electronic GmbH, Fed. Rep. of Germany

[21] Appl. No.: 795,269

[22] Filed: Nov. 5, 1985

[30] Foreign Application Priority Data

Nov. 10, 1984 [DE] Fed. Rep. of Germany ... 8432942[U]

[51] Int. Cl.[4] ..... F04D 25/08

[52] U.S. Cl. ..... 416/39; 416/247 R; 337/380

[58] Field of Search ..... 416/39, 247 R; 415/47, 415/118; 417/32; 98/31.5; 337/380

[56] References Cited

U.S. PATENT DOCUMENTS

| | | | |
|---|---|---|---|
| 2,499,446 | 3/1950 | Anthony | 416/247 X |
| 2,619,578 | 11/1952 | Jepson et al. | 416/5 X |
| 2,944,168 | 7/1960 | Hall | 416/39 X |
| 4,515,538 | 5/1985 | Shih | 416/5 X |

FOREIGN PATENT DOCUMENTS

| | | | |
|---|---|---|---|
| 659471 | 3/1963 | Canada | 416/39 |
| 941220 | 4/1956 | Fed. Rep. of Germany | 415/47 |
| 1052737 | 1/1954 | France | 415/47 |
| 792399 | 3/1958 | United Kingdom | 415/47 |
| 1418291 | 12/1975 | United Kingdom | 417/32 |

*Primary Examiner*—Everette A. Powell, Jr.
*Attorney, Agent, or Firm*—Bacon & Thomas

[57] ABSTRACT

An improved mounting system for attaching a temperature switch to a fan structure is disclosed having a housing which may be directly attached to the protective grille of the fan. The housing may be detachably mounted on the fan structure such that it locates a temperature sensor of the temperature switch in the airstream generated by the fan. The temperature switch is connected to a control system which controls the fan in conjunction with the temperature of the airstream.

4 Claims, 3 Drawing Figures

Fig.1
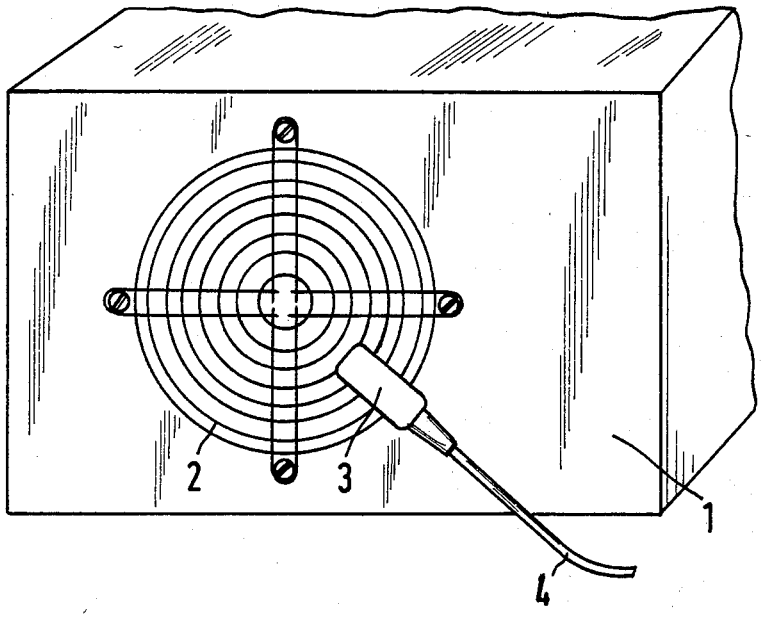
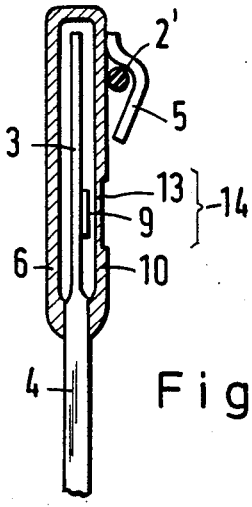
Fig.2
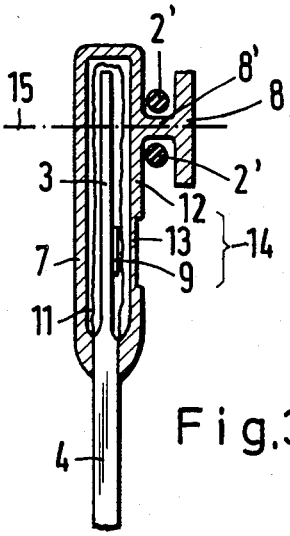
Fig.3

TEMPERATURE SWITCH MOUNTING MEANS FOR A FUNCTION-MONITORING FAN

FIELD OF THE INVENTION

The present invention relates to an improved mounting system for attaching a temperature switch having a temperature sensor to a fan structure. The temperature switch is mounted such that the temperature sensor is located in the airstream generated by the fan so as to accurately control the fan.

BRIEF DESCRIPTION OF THE PRIOR ART

Many systems are known for controlling the operation of a fan, such as in a heat exchanger or air conditioning system, by detecting the characteristics of the airstream generated by the fan. Wind-vane relays are one type and require that the weather vane of the relay be located in the flow of the fan airstream. The weather vane controls a relay which may signal the presence or absence of an airstream generated by the fan. Systems including such relays may only indicate the presence or absence of the airstream, and are susceptible to soiling and to mechanical malfunctions.

Electronic control loops are another known system for monitoring the fan operation. Such control loops emit a signal when the fan or the fan motor fails. However, such control loops are expensive to install and have proven to be somewhat unreliable when subjected to the flow of hot air from the fan.

SUMMARY OF THE INVENTION

It is an object of the present invention to provide an improved mounting system for attaching a temperature switch to the fan structure, such that a temperature sensor included in the switch structure is located in the airstream generated by the fan. The switch will then accurately indicate malfunctions or defects which may cause a change in the temperature of the air moved by the fan in a simple and reliable fashion.

In one embodiment of the invention, a housing containing the temperature switch is attached directly to the protective grille ofthe fan structure to enable the direct measurement of the temperature of the airflow. Control means connected to the temperature switch may undertake a protective step when the air temperature emanating from the fan varies from a predetermined temperature range. This provides a much more accurate control of the fan than the prior art devices.

If the fan is incorporated into a heat exchange structure, the temperature switch may be located in the hot air downstream from the fan. The switch may also be located in the airflow moving toward the fan, as in a fan-equipped air conditioner. In each case, the temperature switch is located at a site where an optimal diagnosis of the particular conditions can be undertaken and transmitted by the temperature switch.

The housing containing the temperature switch may be removably attached to the wire of the protective grille of the fan. The housing is formed of a thermally conducting material, and means are provided for electrically insulating the temperature switch. This may be achieved by forming the housing itself from an electrically insulating material, or by covering the switch within the housing with an electrically insulating foil material. This serves to completely electrically insulate the switch from the fan structure, while at the same time provide good thermal conductivity between the airstream and the temperature switch.

BRIEF DESCRIPTION OF THE DRAWING

FIG. 1 is a partial view of a fan structure showing the temperature switch attached to the protective grille of the fan.

FIG. 2 is a partial, longitudinal sectional view of the first embodiment of the temperature switch according to the invention.

FIG. 3 is a partial, longitudinal sectional view of a second embodiment of the temperature switch according to the invention.

DETAILED DESCRIPTION OF THE PREFERRED EMBODIMENTS

As shown in FIG. 1, the fan 1 has protective grille 2 with temperature switch 3 mounted thereon. Power supply cable 4 is electrically connected to the temperature switch and to a control means which controls the operation of the fan system. Air moving toward or away from the fan 1 passes through the protective grille 2 and contacts the temperature switch 3.

Temperature switch 3 may be detachably mounted on the protective grille as shown in FIGS. 2 and 3. In FIG. 2, a spring clip 5 is attached to a housing 6 which encloses temperature switch 3. Spring clip 5 is slipped over wire 2' of the protective grille 2 so as to attach the housing 6 to the protective grille.

An alternative structure for mounting the temperature switch 3 to the protective grille is shown in FIG. 3. In this embodiment, housing 7 has a "T" shaped strap 8 extending from one side. The width of the "T" shaped strap 8 is less than the distance between protective grille wires 2' such that, when the housing is rotated approximately 90° from its orientation in FIG. 3, the "T" shaped strap may be inserted between the wires 2'. Rotation of the housing approximately 90° will orient the "T" shaped strap 8 in its position shown in FIG. 3 and retain the housing 7 to the protective grille 2.

"T" shaped strap 8 may be integrally formed with housing 7 or may be attached thereto by screw means inserted through a hole formed in the housing and the strap, indicated by numeral 15.

The housing of the temperature switch may also be attached to the rim of the airflow passage rather than the protective grille. Indeed, the housing may be attached by any means to the fan structure as long as temperature sensor 9 of the temperature switch 3 is located such that it is in the airstream generated by the fan.

The precise structure of the temperature switch 3, per se, and the temperature sensor 9 does not form a part of the instant invention. Any known temperature switch and temperature sensor may be utilized in a known manner with the present invention. Generally, the temperature sensor 9 has a fixed temperature at which the switch will operate, although temperature switches having adjustable switching temperatures may also be utilized with this invention.

As shown in FIG. 2, the temperature switch 3 along with its temperature sensor 9 are located in housing 6 which is formed of an electrically insulating and thermally conducting material. Typically, the housing 6 may be formed of a plastic material and is joined in a thermally conducting manner to the temperature switch 3.

An electrically insulating casing 11 may be provided for the temperature switch 3 and the temperature sensor 9 as shown in FIG. 3. This casing is formed of a thin, foil-like electrically insulating material and is located between the temperature switch 3 and the housing 7. Housing 7 may be made of plastic, although it also may be made of metal, since the electrically insulating characteristics are provided by casing 11. Obviously, housing 7 is attached to the temperature switch 3 in a thermally conducting manner.

In each of the embodiments shown in FIGS. 2 and 3, housing 6 or 7 has a substantially constant wall thickness except for the portion of the wall located adjacent to temperature sensor 9. This area, designated by numeral 13 in FIGS. 2 and 3 is thinner than the remaining wall thickness to provide an intensive and rapid heat transfer into the zone 14 which is located in the fan's airstream.

The foregoing description is provided for illustrative purposes only and should not be construed as in any way limiting this invention, the scope of which is defined solely by the appended claims.

What is claimed is:

1. A device for attaching a temperature switch having a temperature sensor to a protective grille of a fan copmrising:

(a) an imperforate housing completely encasing the temperature switch and temperature sensor, the housing having a given wall thickness and formed of a thermally conducting material;

(b) a reduced thickness portion defined by the housing wall located adjacent the temperature sensor to facilitate heat transfer between air flow passing through the fan and the temperature sensor; and (c) attachment means fixedly mounted on the housing for attaching the housing to the protective grille of the fan such that the reduced thickness wall portion is exposed to the air flow produced by the fan.

2. The device according to claim 1 wherein the attachment means comprises a spring clip having one end fixedly attached to the housing and adapted to engage the protective grille.

3. The device according to claim 1 wherein the protective grille has at least a pair of grille wires spaced apart a given distance and wherein the attachment means comprises a generally "T" shaped strap having the base of the "T" attached to the housing, the maximum width of the strap exceeding the distance between the grille wires and the axial length of the strap being less than the distance between the grille wires such that the strap may be inserted between the grille wires and rotated approximately 90° to engage the grille wires.

4. The device according to claim 3 further comprising electrical insulating means encasing the temperature switch and the temperature sensor, the insulating means being disposed between the switch and sensor, and the imperforate housing.

* * * * *